United States Patent [19]

Sato et al.

[11] 3,988,636

[45] Oct. 26, 1976

[54] MAGNETRON WITH CATHODE END SHIELDS COATED WITH SECONDARY ELECTRON EMISSION INHIBITING MATERIAL

[75] Inventors: Masami Sato, Mobara; Hiroshi Hisada, Ichihara; Tomokatsu Oguro, Mobara, all of Japan

[73] Assignee: Hitachi, Ltd., Tokyo, Japan

[22] Filed: Mar. 26, 1975

[21] Appl. No.: 562,353

[30] Foreign Application Priority Data

Apr. 2, 1974 Japan ..... 49-37661[U]

[52] U.S. Cl. ..... 315/39.51; 313/106; 313/107; 313/240

[51] Int. Cl.[2] ..... H01J 25/50

[58] Field of Search ..... 313/106, 107, 240; 315/39.51

[56] References Cited

UNITED STATES PATENTS

| | | | |
|---|---|---|---|
| 2,454,031 | 11/1948 | Bondlet | 313/107 X |
| 2,536,673 | 1/1951 | Widell | 313/107 X |
| 2,957,100 | 10/1960 | Espersen et al. | 313/107 X |
| 3,027,480 | 3/1962 | Tuinila et al. | 313/107 |
| 3,308,329 | 3/1967 | Foreman et al. | 313/107 |
| 3,555,334 | 1/1971 | Van De Goor | 313/107 |
| 3,604,970 | 9/1971 | Campbell et al. | 313/106 |

*Primary Examiner*—Saxfield Chatmon, Jr.
*Attorney, Agent, or Firm*—Charles E. Pfund

[57] ABSTRACT

In a magnetron comprising a cathode electrode, an anode electrode surrounding the cathode electrode and end shields mounted on the opposite ends of the cathode electrode, the inner surfaces of one or both end shields are provided with thin layers of a powder of tungsten, molybdenum, or alloys thereof.

12 Claims, 4 Drawing Figures

FIG.1
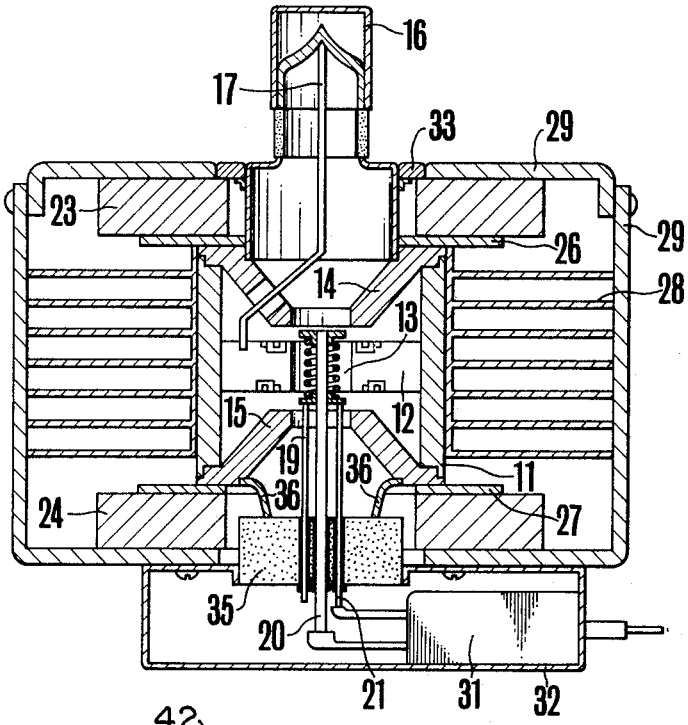
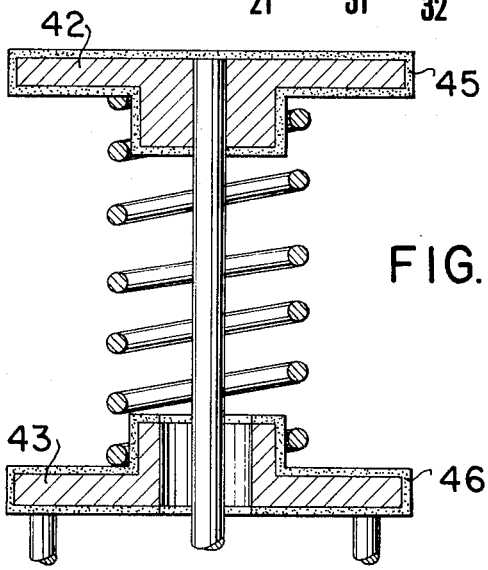
FIG. 4

MAGNETRON WITH CATHODE END SHIELDS COATED WITH SECONDARY ELECTRON EMISSION INHIBITING MATERIAL

BACKGROUND OF THE INVENTION

This invention relates to a magnetron, and more particularly to an improved construction of the end shield of a cathode structure of a magnetron.

Magnetrons are used as ultra-high frequency oscillators for use in microwave ovens or the like. Usually, in the case of the home use microwave ovens the cathode heater voltage and the anode voltage are applied simultaneously to the magnetron. Under such conditions, at the time of starting the operation of the magnetron, the normal $\pi$ mode oscillation would not be established until the cathode electrode is heated up to a predetermined operating temperature. Moreover, as any noticeable anode current does not flow during starting, the anode voltage is higher than during normal operation. As the thermal electron emission from the cathode electrode increases from such condition, a portion of the electrons that collide upon the end shield of the cathode structure generates secondary electrons which collide upon the surface of the other end shield confronting said first mentioned end shield on the other side of the cathode electrode thus generating another secondary electrons which creates secondary electron multiplication phenomena. A portion of the secondary electrons is attracted by the anode electrode thus passing a small anode current. However, as the thermal electron emission increases, the space charge in the operating space changes the distribution of electric field whereby the secondary electron multiplication phenomena disappear abruptly. Accordingly, the anode current also rapidly decreases to zero whereby a large counter electromotive force is created in the high voltage of the power supply thus generating a surge voltage in the form of a pulse. Then, the normal $\pi$ mode oscillation condition is reached after a higher mode oscillation other than the $\pi$ mode. In this manner, when a surge voltage is generated at the time of starting the operation of the magnetron, insulations of not only the filter circuit for the magnetron but also of the high voltage source transformer, rectifier, etc. are destroyed. This not only endangers the operator but also causes a fire hazard.

For the purpose of obviating these problems it has been proposed to weld zirconium plates to the opposing surfaces of a pair of end shields. According to this construction, the low secondary electron emission ratio of zirconium is utilized to suppress the secondary electron emission, but as the secondary electron emission ratio of the zirconium plates is influenced greatly by the surface irregularity, condition of oxidation, and matters deposited on the surface, for example evaporated cathode substance, it is difficult to stably suppress the secondary electron emission. Furthermore as the zirconium plates are liable to deform when they adsorb gas even when the plates are securely fixed in the desired positions at the beginning of the use, the plates adsorb gas and deform during use thus causing short circuits of the electrodes. To prevent such deformation, it is necessary to firmly secure the zirconium plates to the end shields. To be securely fixed, the zirconium plates must be thin. However, from the standpoint of the deformation during use and the property of adsorbing gas, the zirconium plates must not be too thin. Thus, the property of gas adsorption and prevention of deformation contradict each other so that it is difficult to simultaneously satisfy these contradicting requirements. Further, zirconium plates react vigorously with hydrogen, and once such reaction occurs, the effect of suppressing the secondary electron emission decreases greatly. For this reason, it is necessary to fabricate the cathode structure by brazing the component parts thereof in vacuum, thus requiring complicated and expensive manufacturing installations. As an alternative, it has been proposed to weld the zirconium plates on the end shield surfaces after the fabrication of the cathode structure has been completed. However, in such method it is extremely difficult to weld the zirconium plate completely. Thus, it has been difficult to obtain a construction of the cathode electrode capable of efficiently preventing generation of surge voltage and insulation puncture.

SUMMARY OF THE INVENTION

Accordingly, it is an object of this invention to provide an improved magnetron wherein the secondary electron emission is efficiently suppressed.

Another object of this invention is to provide a novel magnetron provided with end shields that can be mass produced and having an improved secondary electron suppression effect.

Still another object of this invention is to provide an improved magnetron in which the secondary electron suppression effect does not vary with year.

According to this invention these and further objects can be accomplished by providing a magnetron of the type including a cathode electrode, an anode electrode surrounding the cathode electrode, and end shields mounted on the opposite ends of the cathode electrode, wherein a portion of the inner surfaces of the end shields is provided with a layer of a metal powder. The metal layers may be provided on the inner surface of one or both end shields. The metal powder may be made of tungsten, molybdenum, or alloys thereof.

BRIEF DESCRIPTION OF THE DRAWINGS

In the accompanying drawings:

FIG. 1 is a longitudinal sectional view of a magnetron embodying the invention;

FIG. 4 is a fragmentary view showing shields substantially completely coated with metal powder.

DESCRIPTION OF THE PREFERRED EMBODIMENT

Figure 2:
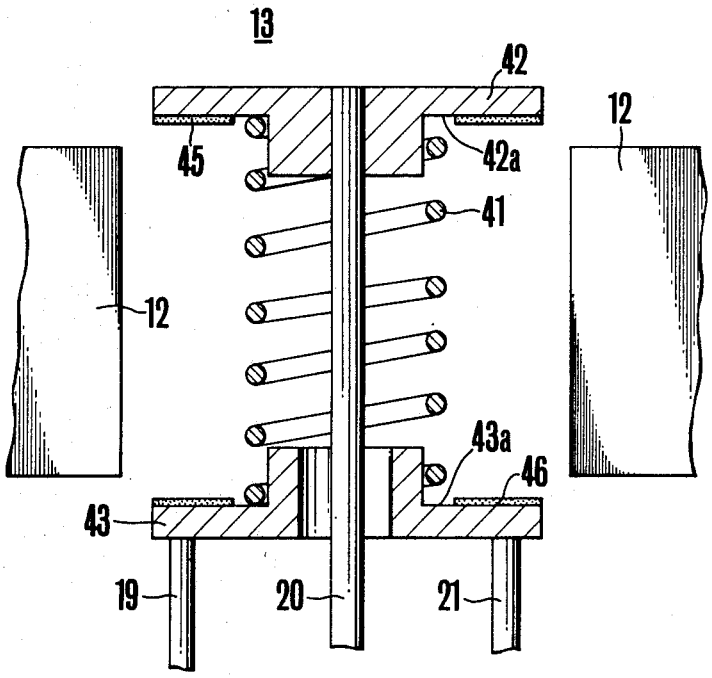
FIG. 2 is an enlarged sectional view of a cathode structure provided with end shields on both sides thereof.

A preferred embodiment of the magnetron of this invention shown in FIG. 1 comprises an anode cylinder 11 provided with a plurality of radial vanes 12 secured to the inner wall thereof. At the center of the anode cylinder 11 is disposed a cathode structure 13. Frustum shaped magnetic pole pieces 14 and 15 are disposed on the opposite ends of the anode cylinder. An antenna 17 extends through the magnetic pole piece 14 between the space in which the vanes 12 are located and an output terminal 16, and three lead conductors 19, 20 and 21 connected to the cathode structure 13 extend downwardly through the center of the other magnetic pole piece 15. Permanent magnets 23 and 24 are disposed close to the magnetic pole pieces 14 and 15 respectively and flux focusing rings 26 and 27 are disposed between the permanent magnet 23 and the magnetic pole piece 14 and between the permanent magnet 24 and the magnetic pole piece 15. A plurality of heat radiating fins 28 are provided to surround the anode cylinder 11 and the component parts described above are contained in an iron casing 29. A casing 32 containing a filter 31 for suppressing the unwanted electromagnetic wave leakage propagating through the input terminal of the cathode voltage is secured to the bottom of the casing 29. A gasket 33 is mounted on the inner periphery of the casing 29 and a stem 35 is provided at the bottom center of the casing 29 for supporting the lead conductors 19, 20 and 21. A support 36 for supporting the stem 35 is also mounted on the magnetic pole piece 15.

FIG. 2 shows an enlarged view of the cathode structure 13 utilized in the magnetron shown in FIG. 1. As shown in FIG. 2, the cathode structure 13 comprises a helical filament 41 acting as the cathode electrode and a pair of disc shaped end shields 42 and 43 are positioned on the opposite ends of the filament 41 and provided with confronting projections. The opposite ends of the filament are brazed to the projections of the end shields 42 and 43. One end shield 42 is connected to lead conductor 20 which extends through an opening at the center of the other end shield 43. In this example, the end shields 42 and 43 are made of molybdenum whereas the lead conductors 19, 20 and 21 are made of molydbenum or tungsten. Lead conductors 19 and 21 are secured to the lower surface of the end shield 43. The opposing surfaces of the end shields 42 and 43 are coated with annular layers 45 and 46 of a metal powder. The layers 45 and 46 are prepared in the following manner. As the metal powder are used such high melting point metals as molybdenum, and tungsten, because the filament is made of thoriated tungsten which is required to be brazed at a temperature higher than 1700° C so that the metal powder should be made of metals having higher melting points. The particle size of the metal powder ranges from 0.5 to 10.0 microns, preferably from 0.5 to 5 microns. A metal powder having a mean particle size smaller than 0.5 micron not only decreases the secondary electron suppression effect but also greatly increases the cost of manufacturing. When the metal powder has a mean particle size of more than 10 microns it is impossible to form uniform coatings. Further, the bonding strength of the coating is not high. Such metal particles are mixed with a binder, for example iso-butylmeta acrylate, carbitol acetate or polyvinylalcohol. The mixture is applied onto the opposed surfaces of the end shields 42 and 43 except the projections by dipping, brushing, spraying or printing. The thickness of the layer of the coated metal powder may be thicker than 5 microns, preferably more than 10 microns when one considers the effect of secondary electron suppression, workability and the capability of mass production. The thickness of less than 5 microns causes nonuniform coating and insufficient surge suppression effect. The layers 45 and 46 of the metal powder are applied onto the end shields 42 and 43 to take the form of an annular section whose outer periphery is spaced from the outer edge of each end shield by less than 1 mm, and the filament 41 is mounted around the projection of respective shields 42 and 43 and fixed by brazing, leaving a slight annular gap between the filament and the inner periphery of respective layers 45 and 46.

The reason for this is as follows. If the spacing between the outer periphery of the annular section and the outer edge of the shield is more than 1 mm, an adverse surge voltage will be caused; and with the absence of the slight annular gap between the metal powder and the element, brazing material such as platinum, or an alloy of molybdenum and ruthenium will flow into the layer to fill spaces among the powders so that the suppression of secondary electron emission, i.e. the effect of the present invention, will be impaired.

Figure 3:
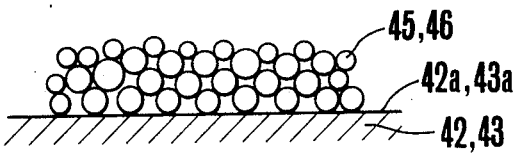
FIG. 3 is an enlarged view of a layer of metal powder applied onto the end shield.

After the solution containing the binder and the metal powder has been applied the coated layers are baked at a temperature of about 1300° C. It is advisable that the baking temperature range is selected within 40 to 90 percent of melting point for the layer used. Below this baking temperature range, the baking strength is reduced giving rise to peeling-off tendancy of the layer. Conversely, above this baking temperature range, the layer is melted, resulting in prevention of the formation of the porous layer. The baking temperature ranges are 1100° C to 2350° C, 1360° C to 2350° C, and 740° C to 1670° C for molybdenum and tungsten, respectively. Since the layer of tungsten is formed on the end shield of molybdenum, the upper limit of the baking temperature for tungsten is dependent on material of the end shield. The layers 45 and 46 of the metal powder formed in this manner are porous as shown in FIG. 3. Consequently, the thermal electrons emanated from the filament of the cathode electrode and impinging upon the layers 45 and 46 are arrested in the interior of the porous layers. Even if the impinging electrons generate secondary electrons, such secondary electrons would be adsorbed by the nearby metal particles thus decreasing the quantity of the secondary electrons emitted to the outside of the porous layers. Accordingly, the apparent ratio of the secondary electron emission will be decreased to a sufficiently small value, thus precluding any secondary electron multiplying phenomenon, and hence any surge.

The invention has the following advantages than the prior art construction.

1. Although metals having a large secondary electron emission ratio such as molybdenum, and tungsten are used, less surge is created than a construction wherein zirconium plates are welded.

2. Where zirconium plates are firstly bonded to the end shields and electrode supports are brazed to the end shields as in the prior art construction, the effect of suppressing the secondary electron emission of the end shields will be lost due to severe reaction between the hydrogen used for brazing and the zirconium plates. For this reason it has been obliged to braze the filament to the end shields in hydrogen atmosphere and then individually weld the zirconium plates to the end shields, thus decreasing the productivity. According to this invention, however, since the layers of the metal powder are firstly applied onto the end shields and then baked and the metal shields are assembled with the filament it is possible to increase the productivity.

3. Since the emission of the secondary electrons is suppressed by the porosity of the layers of the metal particles, even when the cathode material evaporates and deposits onto the end shields or the layers and even when the degree of vacuum and schedule of the evacuation process vary, the effect of such variation is negligibly small.

4. Since no weld is used to fix component parts, peeling off thereof during use does not occur.

Instead of using such metals as molybdenum, and tungsten as the metals for forming the metal layers 45 and 46, it is also possible to use alloys of these metals.

Where a powder of molybdenum or tungsten is coated on one end shield for the purpose of suppressing secondary electrons and a powder of zirconium is coated on the other end shield for providing a getter effect it is possible to simultaneoulsy satisfy suppression of the secondary electrons and getter effect. Since the powder of molybdenum or tungsten has a remarkable effect of suppressing emission of the secondary electrons, the coating thereof may be provided for only one of the end shields. Instead of forming the layers of the metal powder on only the opposed surfaces of the end shield, such layers may be applied on substantially all surfaces of the end shields as by dipping or spraying, as shown in FIG. 4. This construction also increases heat radiation.

It should be understood that the invention is not limited to the particular embodiment described above and that many changes and modifications will be obvious to those skilled in the art without departing from the spirit and scope of the invention as defined in the appended claims.

What is claimed is:

1. In a magnetron of the type including a cathode electrode, an anode electrode surrounding the cathode electrode, and end shields mounted on the opposite ends of the cathode electrode, the improvement which comprises a layer of a metal powder selected from the group molybdenum, tungsten and alloys thereof to suppress secondary electron emission applied onto a portion of the opposing surfaces of said end shields.

2. The magnetron according to claim 1 wherein said layer is formed on the inner surface of one end shield.

3. The magnetron according to claim 1 wherein said layer is formed on the inner surfaces of both end shields.

4. The magnetron according to claim 1 wherein said layer is made of a powder of a metal selected from the group consisting of molybdenum, tungsten, and alloys thereof.

5. The magnetron according to claim 1 wherein said layer of metal powder takes the form of an annular ring.

6. The magnetron according to claim 1 wherein said metal powder has a mean particle size of from 0.5 to 10.0 microns.

7. The magnetron according to claim 1 wherein said layer of metal powder is baked after the layer has been formed.

8. The magnetron according to claim 1 wherein said layer of metal powder has a thickness of more than 5 microns.

9. The magnetron according to claim 1 wherein each end shield takes form of a circular disc having an inwardly projecting projection and said layer of metal layer is formed on the inner surface of said disc to surround said projection.

10. The magnetron according to claim 9 wherein said layer of metal powder is formed on a region from the outer periphery of said disc to a point less than 1 mm from said periphery.

11. The magnetron according to claim 9 wherein the cathode electrode comprises a helical filament with its opposite ends soldered to the peripheries of the projections of the end shields and the layers of the metal powder are formed about the projections with gaps therebetween.

12. A magnetron comprising a cathode electrode, an anode electrode surrounding the cathode electrode, end shields mounted on the opposite ends of the cathode electrodes, and layers of a metal powder selected from the group molybdenum, tungsten and alloys thereof to suppress secondary electron emission applied to substantially all surfaces of said end shields.

* * * * *